United States Patent [19]

Shapiro et al.

[11] Patent Number: 4,711,826

[45] Date of Patent: Dec. 8, 1987

[54] IRON-NICKEL ALLOYS HAVING IMPROVED GLASS SEALING PROPERTIES

[75] Inventors: Eugene Shapiro, Hamden, Conn.; Michael L. Santella, Knoxville, Tenn.

[73] Assignee: Olin Corporation, New Haven, Conn.

[21] Appl. No.: 822,973

[22] Filed: Jan. 27, 1986

[51] Int. Cl.[4] ..... C22C 38/08; C22C 30/00; H05K 5/06

[52] U.S. Cl. ..... 428/630; 174/52 FP; 357/67; 420/94; 420/95; 420/96; 420/97; 420/98; 420/459; 420/581; 420/582; 420/583; 420/584; 420/585; 420/586

[58] Field of Search ..... 75/124; 420/581-589, 420/94-98, 459; 428/630, 620; 174/52 FR; 357/67, 71

[56] References Cited

U.S. PATENT DOCUMENTS

| | | | |
|---|---|---|---|
| 1,514,064 | 11/1924 | Mandell | 420/441 |
| 1,759,477 | 5/1930 | Armstrong et al. | 75/123 H |
| 1,760,326 | 5/1930 | Stablein | 75/123 K |
| 1,768,238 | 6/1930 | Elmen | 178/45 |
| 1,818,054 | 8/1931 | Elmen | 75/123 K |
| 3,183,454 | 6/1964 | Williams | 179/84 R |
| 3,404,999 | 10/1968 | Tanzman et al. | 75/0.5 C |
| 3,705,827 | 12/1972 | Muzyka et al. | 75/123 K |
| 4,149,910 | 4/1979 | Popplewell | 65/43 |
| 4,172,742 | 10/1979 | Rowcliffe et al. | 75/124 |
| 4,442,068 | 4/1984 | Sugitani et al. | 75/124 |

FOREIGN PATENT DOCUMENTS

| | | | |
|---|---|---|---|
| 64743 | 4/1984 | Japan | 420/581 |
| 554703 | 8/1978 | U.S.S.R. | 420/581 |
| 662612 | 5/1979 | U.S.S.R. | 420/581 |

OTHER PUBLICATIONS

"Iron-Nickel Alloys", *Metals Handbook*, 8th Edition, vol. 1, 1961, pp. 788-791.

*Primary Examiner*—L. Dewayne Rutledge
*Assistant Examiner*—Robert L. McDowell
*Attorney, Agent, or Firm*—Paul Weinstein

[57] ABSTRACT

The present invention relates to iron-nickel alloys having improved glass sealing properties. Alloys of the present invention contain from about 30% to about 60% nickel, from about 0.5% to about 3% silicon, from about 0.5% to about 3.5% aluminum and the balance essentially iron. Preferably, the alloys have a total aluminum plus silicon content of less than about 4%. The alloys of the present invention have particular utility in electronic and electrical applications. For example, they may be used as a lead frame or a similar component in a semiconductor package.

16 Claims, 1 Drawing Figure

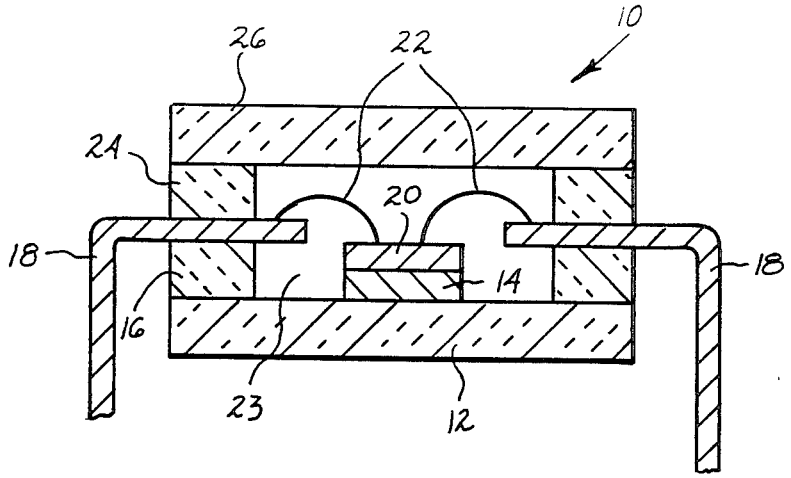
10
26
22
24
20
18
14
18
16
23
12

IRON-NICKEL ALLOYS HAVING IMPROVED GLASS SEALING PROPERTIES

The present invention relates to iron-nickel alloys having particular utility in electronic and electrical applications. Iron-nickel alloys in accordance with the present invention contain aluminum and silicon within certain critical limits to improve the glass sealing properties of the alloys.

There are many metal-glass-ceramic applications and systems which have in common the bonding of a glass or ceramic material to the surface of a metal. One common application is the fabrication of hermetic semiconductor packages. In these applications, it is desirable to use materials having substantially similar thermal coefficients of expansion. By using such materials, it is possible to avoid introducing thermally induced stresses into the glass or ceramic materials adjacent to the metal layer and into the metal-to-glass/ceramic interface. It is also desirable in many of these applications to use metals that form chemical bonds with the adjacent layers of non-metallic material(s).

Iron-nickel alloys such as those shown in U.S. Pat. Nos. 1,514,064 to Mandell, 1,759,477 to Armstrong et al., and 3,705,827 to Muzyka et al. have been used in a wide variety of applications. Today, one of the uses for iron-nickel alloys such as Fe-42Ni is in semiconductor packages as a lead frame material. However, the use of these alloys in semiconductor package applications has not been without problems. One deficiency of many iron-nickel alloys is their relatively high thermal coefficents of expansion as compared to the surrounding glass/ceramic materials. When exposed to heat during normal package processing, these metals expand less than the adjacent glass/ceramic layer(s) to which they are bonded. This expansion mismatch often causes thermally induced stresses in both the adjacent glass-/ceramic layer(s) and the interface(s) between the metal and the glass/ceramic layer(s).

Another deficiency of many of these alloys is the type of bond they form with typical sealing glass materials during semiconductor package fabrication. In many semiconductor packages, a mechanical compression bond is formed between the metal forming the lead frame and the adjacent glass layer(s). This type of bond is formed during processing as the glass contracts around the metal during cooling from a higher temperature processing step. Mechanical compression bonds are undesirable because they do not have good resistance to handling damage and do not form a good seal at sharp corners. In addition, the glass layer is generally placed into tension which reduces the overall strength of the glass. To avoid these problems, it is desirable to use a metal or metal alloy which produces a chemical bond with adjacent glass/ceramic layers as a lead frame material.

Attempts have been made to develop iron alloys having improved glass sealing properties. U.S. Pat. Nos. 3,183,454 to Williams and 4,149,910 to Popplewell illustrate two such attempts. The Williams alloy contains from an impurity level to 0.10% carbon, from about 0.25% to 1.25% manganese, up to 1% silicon, from 0.08% to 1% zirconium, from 35% to 55% nickel, and the remainder iron and incidental impurities. The Popplewell alloy contains from about 1 to 5% silicon, from about 1 to 10% chromium and the remainder iron. Additional elements which can be added to this alloy include from about 0.001 to 1% aluminum, from about 0.001 to 5% nickel, from about 0.001 to 5% cobalt, and from about 0.001 to 1% carbon. While these alloys have been known for some time, semiconductor package manufacturers are still seeking other alloys having excellent glass sealing properties and thermal coefficents of expansion that closely match the thermal coefficients of expansion of typical sealing glass materials.

Accordingly, it is an object of the present invention to provide an iron-nickel alloy having improved glass sealing properties.

It is a further object of the present invention to provide an alloy as above having particular utility in electronic applications.

It is a further object of the present invention to provide an alloy as above having particular utility as a lead frame material.

These and other objects and advantages will become more apparent from the following description and drawing in which like numerals depict like elements.

The present invention achieves the foregoing objects by making alloying additions of aluminum and silicon to iron-nickel containing alloys. The addition of these elements to iron-nickel alloys has been found to improve the glass sealing properties of the alloys. It is believed that these additions encourage oxide formation during the heating cycle for glass sealing and thereby promote the formation of chemical bonds as opposed to mechanical compression bonds. These additions within certain limits also produce alloys having thermal coefficents of expansion substantially similar to those of typical glass sealing materials.

Alloys in accordance with the present invention contain from about 30% to about 60% nickel, from about 0.5% to about 3% silicon, from about 0.5% to about 3.5% aluminum and the balance essentially iron. In addition to the foregoing compositional ranges, the alloys preferably have a total silicon plus aluminum content of less than about 4%. Preferred alloys consist essentially of from about 33% to about 46% nickel, from about 0.9% to about 3% silicon and from about 0.5% to about 2% aluminum and the balance essentially iron.

The FIGURE is a cross sectional view of a semiconductor package.

The present invention relates to iron-nickel alloys having improved glass sealing properties. These alloys have particular utility in electrical and electronic applications. For example, the alloys may be used for lead frames or similar components in semiconductor packages. Alternatively, they may be used for pins in TO cans, glass-to-metal power feed throughs or other similar applications.

Referring now to the FIGURE, a typical semiconductor package 10 is illustrated. The package 10 comprises a ceramic base 12, a first glass layer 16 and a number of leads 18 from a lead frame bonded to the ceramic base 12 by the glass layer 16. A semiconductor device 20 is mounted to the base 12 by either a die attach pad or a layer of gold containing material 14. The gold containing material is used in many modern packages to permit formation of a gold-silicon eutectic bond between the layer 14 and the chip 20. The gold containing layer 14 may comprise either a gold plating or a gold paste fired to the ceramic base 12. The device 20 is connected to the leads 18 by a number of lead wires 22. Generally, the lead wires are formed from aluminum or an aluminum alloy such as A1-1%Si. A second glass layer 24 is positioned over the leads 18 of the lead frame assembly. To complete the package, a cover 26 formed from a ceramic or metallic material is placed over the glass layer 24.

In some packages, the glass layer 24 and the cover 26 each have a central aperture or window to permit the device 20 to be bonded to the pad or layer 14 and the wire connections to be made after the glass layer 24 and/or the cover 26 have been fused to the glass layer 16. A cap not shown is provided to close the window after the device has been positioned on the pad and the wire connections are made. The cap may be formed from a ceramic material, a metallic material such as gold plated Kovar, or a glass material.

To fabricate the semiconductor package illustrated in the FIGURE, the die attach pad or gold containing layer 14 is first bonded to or plated onto the ceramic base 12. The glass layer 16 is then screen printed on the ceramic base and air fired, leaving an aperture or window 23 for connecting the semiconductor device 20 to the pad or layer 14. The lead frame with the leads 18 is then positioned on the glass layer 16 and fused into place. Preferably, the second glass layer 24 is joined to the cover 26 before being fused to the layer 16. Thereafter, the glass layer 24 is fused to the glass layer 16 to form a hermetic package structure. Prior to this, however, the device 20 is attached to the pad or layer 14 and the wire interconnections are made between the device 20 and the leads 18. Typically, the wire interconnections are made using either a thermocompression, ultrasonic or thermosonic bonder in an ambient atmosphere. This wire bonding operation often results in surface oxides being formed on the leads 18.

Typical ceramic materials used in packaging integrated circuit chips or semiconductor devices include aluminum oxide and beryllium oxide. The glass layers 16 and 24 in these packages may be formed from any suitable glass material such as lead containing glasses, e.g. an 85% lead oxide-15% boric acid composition.

It should be recognized that the package shown in the FIGURE and the discussion attendant thereto are meant to be illustrative and are not meant to limit the scope of the invention. The alloys of the present invention may be used in conjunction with a wide variety of package constructions and materials.

As previously discussed, the leads 18 and the lead frames in many modern packages are formed from iron alloys such as Fe-42Ni. The use of these alloys as lead frame materials has engendered several significant problems. These problems include poor glass sealing performance and the introduction of thermally induced stresses into the glass and/or ceramic layers of the package. These problems are significant because they lead to poor package hermeticity characteristics and breakage of the package. Attempts to overcome these problems have included coating and/or striping the leads 18 of the lead frames with materials such as aluminum, gold and alloys thereof to improve the glass sealing properties. Of course, coating and/or striping increases the package manufacturing costs.

In accordance with the present invention, these problems are overcome by using for the leads and the lead frame an iron-nickel alloy which exhibits improved glass sealing properties and a thermal coefficient of expansion closely matched to that of typical glass sealing materials. Alloys of the present invention include those having a composition consisting essentially of from about 30% to about 60% nickel, from about 0.5% to about 3% silicon, from about 0.5% to about 3.5% aluminum and the balance essentially iron. Impurities may be present in amounts not adversely affecting the glass sealing properties of the alloy. Preferably, the total aluminum plus silicon content of the alloy is less than about 4%.

It is believed that by making aluminum and silicon alloying additions within the foregoing ranges, the nature of the surface oxides generally formed during the heat treatments associated with packaging and/or glass sealing may be modified to encourage formation of a chemical bond between the iron-nickel alloy of the present invention and the surrounding glass sealing material. It is further believed that the ability to form these chemical bonds greatly improves the glass sealing performance of the alloys of the present invention. The lower limits on the aforementioned aluminum and silicon alloying additions are selected to encourage modification of the surface oxides. The upper limits on these alloying additions are determined by thermal coefficent of expansion considerations. As previously mentioned, it is desirable for the alloy to have a thermal coefficent of expansion closely matched or substantially identical to that of the glass sealing material forming the layers 16 and 24. For this reason in particular, the total aluminum plus silicon content of the alloy is preferably less than about 4%.

In a preferred embodiment, the alloys consist essentially of from about 33% to about 46% nickel, from about 0.9% to about 3% silicon, from about 0.5% to about 2% aluminum and the balance essentially iron.

In addition to the above elements, the alloys of this invention may also contain up to 3% tin to improve solderability. They may also contain one or more elements selected from the group consisting of up to about 10% cobalt, up to about 10% chromium, up to about 10% maganese, up to about 5% molybdenum, up to about 5% tantalum, up to about 5% titanium, up to about 5% vanadium, up to about 10% copper, up to about 5% niobium, up to about 5% zirconium, up to about 0.01% boron and up to about 1% nitrogen to further facilitate solid solution and precipitation hardening. Still further, the alloys may contain up to about 2% of rare earths such as hafnium, yttrium, and mischmetal to improve oxide scale adhesion and to control the oxidation rate of the alloy.

As used herein, the foregoing alloy composition percentages are weight percentages.

The alloys of the present invention may be made in accordance with standard mill practices. For example, the alloys may be cast in any desired manner including but not limited to Durville casting, book mold casting, continuous casting, and direct chill casting, into an ingot or into strip form. After casting, the alloy may be hot worked such as by hot rolling and/or cold worked such as by cold rolling with at least one interanneal for at least about one hour at a temperature of at least about 600° C. Cold work reductions may be in the range of at least about 10% to about 90%.

After processing, the iron-nickel strip material may be fabricated into a desired product such as a lead frame in accordance with any suitable fabrication technique known in the art.

To demonstrate the improvements of the present invention, the following Example was performed.

EXAMPLE

A series of alloys having the compositions shown in Table I were prepared. The alloys were cast into ingots, soaked for two hours at 1000° C., hot rolled to 0.40", and cold rolled to 0.090". After reaching the desired final gage, each alloy strip was cut into a number of sample coupons. Alloy A represents a typical Fe-42Ni alloy composition.

TABLE I

| Alloy | Composition (wt %) | | | |
|---|---|---|---|---|
| | Ni | Al | Si | Mn |
| A | 41.6 | — | <.01 | 0.17 |
| B | 40.9 | — | 2.6 | 0.25 |
| C | 41.5 | 1.0 | 0.9 | 0.24 |
| D | 38.0 | 2.7 | 1.7 | 0.20 |

Tests were then conducted to measure the expansion, torque strength and glass flow sealing properties of each alloy. To measure thermal expansion properties, sample coupons of each alloy were placed in a dilatometer and heated at a fixed heating rate. The metal expansion of each sample was measured during the test at specific temperature points. The average thermal coefficient of expansion up to 300° C. for each alloy is reported in Table II. From the standpoint of producing a metal alloy having a thermal coefficient of expansion closely matched to that of typical sealing glasses, Alloy C provided the best results. A sealing glass such as a lead containing glass designated KC402 has a thermal coefficient of expansion up to 300° C. of about $65\times10^{-7}$ in/in/°C. The thermal coefficient of expansion for Alloy C was $62\times10^{-7}$ in/in/° C. Alloys A, B and D all exhibited less matched thermal coefficients of expansion. This test also suggests that there is criticality to the total aluminum plus silicon content of the alloy. Alloy D having a total silicon plus aluminum content of 4.4% had a thermal coefficient of expansion of $150.3\times10^{-7}$ in/in/°C.

To measure glass sealing ability and bond strength, coupons of each alloy were bonded to coupons of KC402 glass. A torque was then applied to each alloy/-glass composite. The amount of torque needed to break the composite was then measured. As can be seen from Table II, alloys B and C had a torque strength about twice that of Alloy A. Alloy D having a total aluminum plus silicon content of 4.4% had a torque strength of zero. This test also suggests that maintaining the total aluminum plus silicon content of the alloy below 4% is desirable from the standpoint of glass sealing ability and bond strength.

To measure the glass sealing flow for each alloy, a billet of KC402 glass was placed on a sample coupon of each alloy. The billet and coupon were placed in a furnace and heated until the glass began to flow. The increase in diameter of the glass and the wetting angle of the glass were measured. Generally, the lower the wetting angle, the better the quality of the bond between the metal and the glass. As can be seen from Table II, Alloy C again yielded the best results in terms of both flow angle or wetting angle and glass diameter.

TABLE II

| Alloy | Exp. Coeff. ($10^{-7}$ in/in/°C.) | Torque Strength (in./lb.) | Glass Dia. (in.) | Flow Angle (°) |
|---|---|---|---|---|
| A | 46.2 | 21 | .72 | 36 |
| B | 76.9 | 45 | .73 | 48 |
| C | 62.0 | 39 | .75 | 33 |
| D | 150.3 | 0 | .75 | 45 |

It is believed that the foregoing Example illustrates the benefits obtained with the alloys of the present invention.

While the alloys of the present invention have particular utility in electronic and electrical applications, they also have utility in other applications where improved glass adhesion properties are needed. For example, the alloys of the present invention may be used in composite structures such as iron-nickel alloy/glass composites.

The patents set forth in the specification are intended to be incorporated by reference herein.

It is apparent that there has been provided in accordance with this invention iron-nickel alloys having improved glass sealing properties which fully satisfy the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An iron-nickel alloy having improved glass sealing ability, said alloy consisting essentially of from about 33% to about 60% nickel, from about 0.9% to about 3% silicon, from about 0.5% to about 3.5% aluminum and the balance essentially iron.

2. The alloy of claim 1 further comprising the total silicon and aluminum content of said alloy being less than about 4%.

3. The alloy of claim 1 further containing at least one element selected from the group consisting of up to about 10% cobalt, up to about 10% chromium, up to about 10% managanese, up to about 5% molybdenum, up to about 5% tantalum, up to about 5% titanium, up to about 5% vanadium, up to about 10% copper, up to about 5% niobium, up to about 5% zirconium, up to about 0.01% boron and up to about 1% nitrogen to facilitate solid solution and precipitation hardening of said alloy.

4. An iron-nickel alloy having improved glass sealing ability, said alloy consisting of from about 30% to about 60% nickel, from about 0.9% to about 3% silicon, from about 0.5% to about 2% aluminum, the total silicon and aluminum content being less than about 4%, and the balance iron.

5. An iron-nickel alloy having improved glass sealing ability consisting essentially of from about 33% to about 46% nickel, from about 0.9% to about 3% silicon, from about 0.5% to about 2% aluminum and the balance essentially iron.

6. An iron-nickel alloy having improved glass sealing ability, said alloy consisting essentially of from about 30% to about 60% nickel, from about 0.9% to about 3% silicon, from about 0.5% to about 3.5% aluminum, an amount of tin effective to improve the solderability of said alloy up to about 3% and the balance essentially iron.

7. An iron-nickel alloy having improved glass sealing ability, said alloy consisting essentially of from about 30% to about 60% nickel, from about 0.9% to about 3% silicon, from about 0.5% to about 3.5% aluminum, an amount of a rare earth effective to improve oxide scale adhesion and to control the oxidation rate of said alloy up to about 2% and the balance essentially iron.

8. The alloy of claim 7 further comprising said rare earth being selected from the group consisting of hafnium, yttrium, and mischmetal.

9. A composite structure comprising:

at least one component formed from an alloy consisting essentially of from about 30% to about 60% nickel, from about 0.9% to about 3% silicon, from about 0.5% to about 3.5% aluminum and the balance essentially iron; and a layer of glass sealing material bonded to said at least one component.

10. The composite structure of claim 9 further comprising said alloy and said non-metallic material having substantially identical thermal coefficients of expansion.

11. The composite structure of claim 9 further comprising the total aluminum plus silicon content of said alloy being less than about 4%.

12. The composite structure of claim 9 further comprising at least one aluminum or aluminum alloy component bonded to an end of said at least one component.

13. The composite structure of claim 12 further comprising:

a semiconductor device;

said second component comprising at least one layer of a glass sealing material;

at least one layer of a ceramic material; and said at least one component, said at least one glass sealing material layer and said at least one ceramic material layer forming a hermetic package for said semiconductor device.

14. The composite structure of claim 13 further comprising:

said at least one component comprising a lead frame having at least one lead formed from said alloy; and said at least one aluminum or aluminum alloy component comprising at least one lead wire, each said lead wire connecting one of said leads to said device.

15. The composite structure of claim 14 further comprising:

said lead frame being entirely formed from said alloy.

16. A composite structure comprising:

at least one component formed from an alloy consisting essentially of from about 33% to about 46% nickel, from about 0.9% to about 3% silicon, from about 0.5% to about 2% aluminum and the balance essentially iron; and a layer of glass sealing material bonded to said at least one component.

* * * * *